United States Patent [19]

Urban

[11] 4,145,083

[45] Mar. 20, 1979

[54] THERAPEUTIC CHAIR FOR CEREBRAL PALSY CHILD

[76] Inventor: Frank K. Urban, 2455 N. Star, Columbus, Ohio 43215

[21] Appl. No.: 807,803

[22] Filed: Jun. 17, 1977

[51] Int. Cl.[2] ..... A47C 31/00; A47C 3/00; A24B 1/02

[52] U.S. Cl. ..... 297/384; 297/284; 297/DIG. 3

[58] Field of Search ..... 297/384, 284, DIG. 3, 297/326, 328; 280/730, 729, 728, 743

[56] References Cited

U.S. PATENT DOCUMENTS

| | | | |
|---|---|---|---|
| 2,025,436 | 12/1935 | Brosset | 297/326 |
| 3,167,790 | 2/1965 | Hickey | 297/DIG. 3 |
| 3,330,598 | 7/1967 | Whiteside | 297/DIG. 3 |
| 3,424,493 | 1/1969 | Gottfried et al. | 297/384 |
| 3,477,071 | 11/1969 | Emerson | 297/384 X |
| 3,623,768 | 11/1971 | Capener | 280/730 X |
| 3,630,472 | 12/1971 | Axenborg | 280/730 |
| 3,712,674 | 1/1973 | Ando | 297/DIG. 3 |
| 3,761,126 | 9/1973 | Mulholland | 297/384 |
| 3,981,518 | 9/1976 | Pulling | 297/216 X |
| 4,040,655 | 8/1977 | Garrick et al. | 297/DIG. 3 |
| 4,047,755 | 9/1977 | McDonald | 297/216 |
| 4,072,318 | 2/1978 | Laune | 297/328 |

FOREIGN PATENT DOCUMENTS

| | | | |
|---|---|---|---|
| 390865 | 2/1924 | Fed. Rep. of Germany | 297/328 |
| 776934 | 6/1957 | United Kingdom | 297/DIG. 3 |
| 1285552 | 8/1972 | United Kingdom | 297/DIG. 3 |

*Primary Examiner*—James T. McCall
*Attorney, Agent, or Firm*—Mahoney & Stebens

[57] ABSTRACT

A therapeutic chair is provided having angularly displaceable seat bottom and seat back positioned on a supporting base for pivotable movement relative thereto. The seat bottom and seat back include longitudinally extending sidewalls having inwardly facing surfaces which may be selectively displaced inwardly to effectively provide support for the occupant of the chair. Selective displacement of the inner sidewall surfaces is achieved through incorporation of selectively inflatable air cells which are restrained against the respective side walls. These cells are inflated to expand inwardly and provide the proper size adjustment and support of the occupant in maintaining the desired body position for comfort and avoidance of the involuntary extensor thrust positioning.

11 Claims, 5 Drawing Figures

THERAPEUTIC CHAIR FOR CEREBRAL PALSY CHILD

BACKGROUND OF THE INVENTION

The therapeutic chair of this invention is directed primarily to the assistance and aid of a spastic cerebral palsied child to improve the stability of such a child in maintenance of a sitting position and thereby permit the child more useful movement and development of hand activities and operations. Another important objective of the therapeutic chair of this invention, is to better enable the child to avoid the extensor thrust positioning that may involuntarily occur when the child is placed or inadvertently moves into an improper or inappropriate position.

It has been found that the extensor thrust positioning may readily occur when a child contacts a stable object or support such as the floor or a foot rest on a chair structure with his feet. The result of this thrust positioning is that the child's body assumes a relatively contorted position and this position is then maintained unless attendant assistance is obtained for again moving the child to the normal sitting position. Another disadvantage of known structures for assisting children having spastic cerebral palsy is the relative inability of such chairs and other devices or appliances to readily maintain the upper trunk of the child's body in an upright and generally vertically disposed position and resisting lateral movement. Also such previously provided appliances and chairs generally do not provide an adequate support for the head which may involuntarily move in a lateral direction to an extent where the child is incapable by himself or return head movement to a more normal position. Absent the necessary side support, cerebral-palsied children are unable to attempt simultaneous hand movement since one hand is generally used for support and eye-hand movement coordination training is substantially impaired.

SUMMARY OF THE INVENTION

A therapeutic chair is provided by this invention which has been found not only capable of readily providing the necessary support in maintaining a spastic cerebral palsy child in a preferred sitting position, but is also capable of substantially eliminating the involuntary extensoir thrust positioning that can otherwise occur. The chair structure in accordance with this invention includes a seat bottom and seat back which are provided with lateral side walls that serve to maintain a child's upright and generally longitudinally aligned body and trunk position. The seat bottom and seat back are preferably pivotably mounted on a supporting base to permit relative angular positioning of both seat bottom and back to a preferred angular position for optimum support of the child's trunk and legs in a comfortable and more adaptive position for enabling the child to function in effecting use of it's hands and arms as well as maintenance of the head in a position where activities in the surrounding area may be more readily and naturally observed.

In order that the chair structure will be properly adaptive to a specific child, the side walls of both the seat bottom and seat back are formed with inner surface portions which are relatively displaceable in inwardly directed relationship to the chair's structure. This achievement of inward displacement of the inner sidewall surface is obtained through incorporation of selectively inflatable air cells carried and supported in adjacent relationship to each of the side walls. These selectively inflatable air cells may be inflated to a desired degree necessary to attain the particular size as to lateral spacing in either the seat bottom or seat back to properly engage and support the child thus positioned in the chair. The vertical height of the seat back is of an extent to assure that support is also provided for the head and is able to restrict the extreme lateral displacement which may inadvertently occur without such support.

Relative pivoting movement of the seat back to the seat bottom enables one to angularly position these two components to best suppport the cerebral-palsied child. Also, the seat back and seat bottom may be angularly positioned with respect to a supporting base such that the seat bottom will be inclined upwardly from a rear supporting pivot and is of a length such that, when thus upwardly inclined, the child's feet will be incapable of contacting any rigid supporting surface which may tend to trigger the extensor thrust positioning.

These and other objects and advantages of this invention will be readily apparent from the following detailed description of an illustrative embodiment thereof and the accompanying drawings.

DESCRIPTION OF THE DRAWING FIGURES

DESCRIPTION OF THE ILLUSTRATED EMBODIMENT

Figure 1:
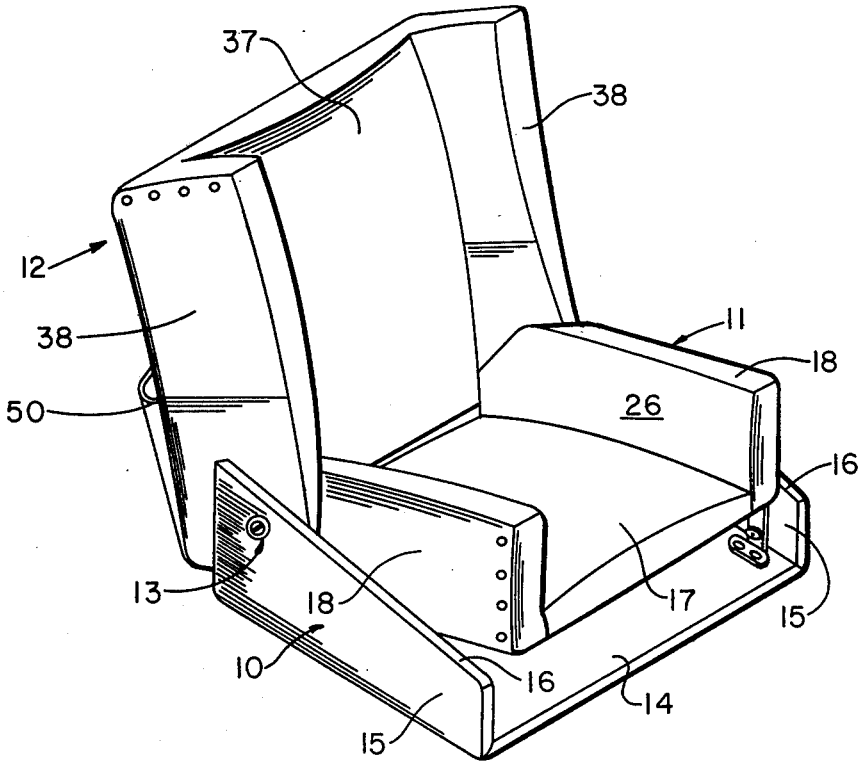
FIG. 1 is a perspective view of a therapeutic chair embodying this invention.

Having reference to the accompanying drawings, a therapeutic chair embodying this invention is illustrated in perspective view in FIG. 1. This chair basically includes a supporting base 10, a seat bottom 11, and a seat back 12. As can be readily seen in the several Figures, these three elements are pivotally interconnected at a common point for relative swinging movement about a horizontal axis extending transversely of the chair. This pivoting movement of the three elements is achieved by a pivot structure indicated generally at 13 in FIG. 1.

Forming the supporting base 10 is a bottom plate 14 and a pair of upstanding side walls 15. These side walls 15 are positioned in laterally spaced relationship to each other at opposite sides of the bottom plate 14 and extend a distance upwardly therefrom. Each of the side walls is preferably formed with a rearwardly and upwardly inclined upper edge 16 with each of the side walls also extending substantially the entire longitudinal length of the bottom plate 14.

Figure 3:
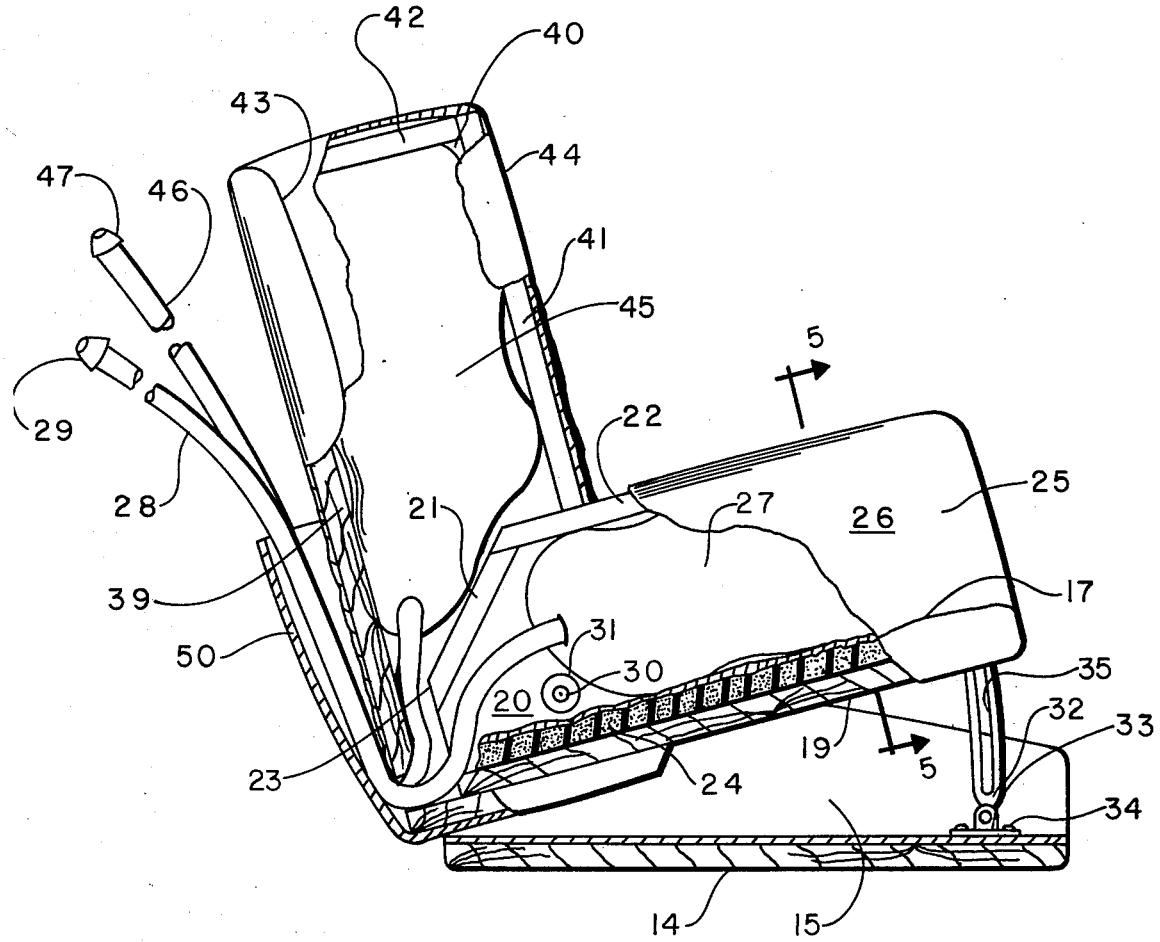
FIG. 3 is a vertical sectional view taken along line 3—3 of FIG. 2.

Forming the seat bottom 11 is a bottom panel 17 and a pair of upstanding side walls 18. Providing the structural rigidity for the seat bottom 11 are structurally rigid elements which may advantageously be formed from plastic or wooden materials. These elements include a flat plate 19 incorporated in a bottom panel 17 and respective side plates 20 which are securely fastened to the respective lateral side edges of the plate 19. Referring to FIG. 3, it will be noted that the upper-rear, end-corner portions of the side plates 20 are preferably terminated in an angularly disposed edge 21 which, as will be explained hereinafter, provides better clearance for the functional operation in angular positioning of the seat bottom with respect to the seat back. Also secured to the side plates 20 along the upper edge portion thereof, including that of the angular edge 21, are inwardly projecting flanges 22 and 23. These flanges 22 and 23 project a distance inwardly and thus define a shallow recess in combination with the bottom plate 19. As illustrated in the several Figures, additional comfort is provided the occupant of this chair through the addition of upholstering or padding to the various surfaces thereof. Accordingly, it will be noted that the seat or bottom panel 17, is provided with a padded covering 24. Similarly, each of the side walls 18 are provided with a covering or sheathing of upholstering material 25 which may extend on both the exterior and inwardly facing vertical surfaces of the sidewalls. While the covering 24 for the bottom panel 17, may be applied in conventional upholstering techniques, the material 25 for the side plates or side walls must be applied in a manner to permit the inward displacement of the inwardly facing surface portions. These inwardly facing surface portions are indicated at 26, in the drawings, and are cut from the material to provide the necessary fullness to permit expansion or inward displacement of these surface portions.

It will be noted that the sheathing 25 covering the side walls thus forms a closed pocket with respect to the side plates 20 and the recess formed by the flanges 22, 23 and adjacent opposed portions of the bottom panel plate 19. Positioned in this pocket of each side wall 18 is an inflatable air cell 27 which is provided with the respective inflating tube 28. The air cells 27 are configured to assume an elongated, generally cylindrical shape and are disposed to extend longitudinally with respect to the respective side walls. The air cells are also disposed and constructed with the inflating tube 28 projecting from one end thereof which, as illustrated and best seen in FIG. 3, is the rearwardly directed end portion whereby the tube 28 may extend outwardly and rearwardly of the seat bottom 11.

Figure 2:
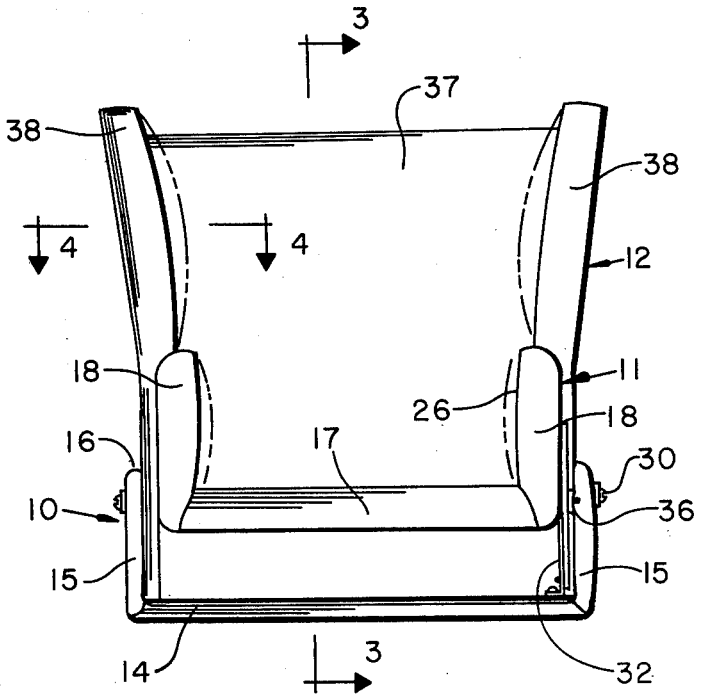
FIG. 2 is a front vertical elevational view thereof.
Figure 4:
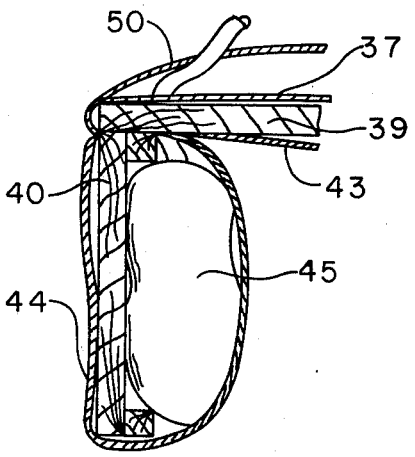
FIG. 4 is a fragmentary vertical sectional view on an enlarged scale taken along line 4—4 of FIG. 3.

Also, as indicated and illustrated in FIG. 3, the tube 28 is provided at one end with a closure valve or sealing element 29. This closure valve 29 may be of the commercially known valve types which permit selective opening for oral inflation of the associated and connected air cell 27. The valve may then be operated to a closed and sealed position to retain the air within the cell. The functional operation of inflating the cells with respect to the seat bottom 11 is illustrated in FIGS. 4 and 2. FIG. 4 is a sectional view which indicates the air cell 27 in a substantially expanded configuration thereby displacing the upholstering sheathing 25 of the side wall inwardly with respect to the seat bottom. It will be readily apparent by reference to FIG. 4, that the degree of inflation of the cell will produce a corresponding displacement of the upholstering or sheathing 25 to achieve the desired size adjustment and support capability through the rigidity of the air cell when substantially inflated.

As previously indicated, the seat bottom 11 is pivotably supported on the base 10 by a pivot structure 13. This pivot structure 13, in the illustrative embodiment, comprises respective pivot pins 30 which project horizontally through the respective side walls 18 in coaxial relationship at the rear end portions of those side walls. Each pivot pin 30 includes a slotted head which is preferably positioned at the exterior of the side wall 15 of the base with the threaded shank projecting horizontally through the respective side walls 15 and 18. This threaded shank is threaded into a fixed nut secured to the inner face of the respective side plate 20. This fixed nut 31 may be of the T-nut type which is particularly adaptable for maintaining the nut in secured relationship to the plate and thus facilitate assembly of the several structural elements.

With the illustrated pivoting of the seat bottom 11 on the respective pivot structures 13, it will be seen that the seat may be angularly inclined in an upwardly and forwardly directed position with respect to the supporting base 10. While the pivot pin 30 may be relatively tightened with respect to the T-nut 31, to maintain the seat bottom in this position, it is preferred that auxiliary support means be provided to assure that the seat bottom will be positively maintained against the weight of the occupant. Such additional support means in the illustrative embodiment takes the form of an arcuately slotted bracket 32, having an end flange 33 which is attached in fixed relationship to the bottom plate 14 by means of wood screws 34. As indicated, the bracket 32 has an arcuate slot 35 which receives a threaded bolt shank carried by the one side plate 18. A wing nut 36 is preferably threaded onto the threaded bolt for securing the bracket in fixed position with respect to the side wall 18.

The seat back 12 also includes a rigid panel 37 and a pair of vertically extending side walls 38. Included in the structurally rigid components of the seat back 12 is a back plate 39 which may be conveniently formed from materials such as wood or suitable synthetic resin plastic materials. Rigidly secured to the back plate 39 at each vertically extending edge thereof are respective side plates 40 which also project a distance forwardly with respect to the back plate 39. Attached to the inwardly facing surfaces of the side plates at the forward edge thereof are respective flanges 41 which extend downwardly from the upper end to a position where the seat bottom 11 passes between the side plates into the interior space defined by the side plates 40. Termination of the flanges 41 at this position thus enables the seat bottom 11 which projects into the base between the side plates 40, to relatively pivot with respect thereto without substantial interference. It will also be noted that the upper end of the side plates 40 are also provided with an end flange 42. Thus it will be seen that the end flange 42 in combination with the flange 41 and opposed surface portions of the back plate 39, defines a recess facing inwardly of the respective side wall or side plate 40.

Figure 5:
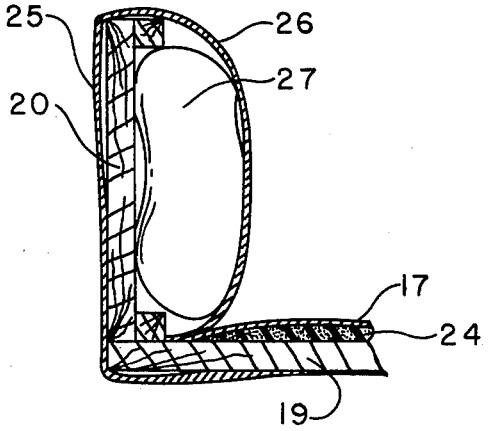
FIG. 5 is a fragmentary horizontal sectional view on an enlarged scale taken along line 5—5 of FIG. 2.

As in the case of the seat bottom 11, the seat back 12 is also provided with covering and padding to enhance the comfort of the occupant. With respect to the back plate 39, or panel 37, this includes a padded upholstering covering 43 which is indicated generally in FIG. 5. Each of the side walls 38 is also provided with a sheathing of upholstering material 44. As best seen in FIG. 5, the sheathing 44 extends around the side plates 40 and is cut with a desired fullness to form an expandable pocket with respect to the interior or inwardly facing surface of the side plate 40.

Positioned in each expandable pockets that is formed by this side plate 40 and associated inner wall portion of the sheathing 44 is a selectively inflatable air cell 45 which is of an elongated configuration to fit within the flange 41 and adjacent surface portions of the back plate 39. The length of the air cell 45 is such that it extends from the upper most end of the respective side wall 38 downwardly to position terminating immediately above the angularly inclined edge 21 and associated portions of the side wall of the seat bottom. Termination of the air cell 45 at this position thus permits the seat bottom and seat back 11 and 12 to relatively pivot with respect to each other without interference. Attached to the lower end of the cell 45 is an elongated inflating tube 46 which is of a length to extend downwardly and outwardly through the rear of the chair structure where it is provided at a terminal end with a suitable closure valve 47. This closure valve may be of the same type as that described in conjunction with valve 29, and is designed to permit oral inflation of the associated air cell. cell.

It will be noted with respect to FIG. 2 that the back panel 37 of the seat back does not have parallel side walls 38. The lower portions of the side walls 38 are parallel where they project into interleaved relationship between the side plates or side walls 18 of the seat bottom and the upstanding side walls 15 of the supporting base. At the point immediately above the location of the uppermost edges of the side walls 18 with respect to the back side walls, it will be seen that these walls diverge in outwardly directed relationship to each other to thus provide a substantially wider upper end portion for the seat back. This design provides the necessary width required for the shoulder portions of the occupant's body.

Attachment of the seat back 12 is accomplished in substantially the same manner as that of the seat bottom with respect to the supporting base 10. As indicated, the side plates 40 of the respective side walls for the seat back project into interleaved relationship between the adjacent portions of the seat bottom and the upstanding walls 15 of the supporting base. Accordingly, the shank of the bolt forming the pivot structure 13 projects through an aperture formed in the side plate 40. Consequently, tightening of the bolt of this pivot structure 13 will frictionally secure the seat back 12 in proper relationship with respect to the seat bottom 11. This pivotable relationship and interconnection of the seat bottom and seat back enables the angular relationship to be properly adjusted to best accommodate a specific child as determined by the extent of the cerebral palsy condition. In some instances, this angular relationship is preferably less than 90° and may be of the order of 75°–80°. This has been found advantageous in proper support of the child to provide the necessary comfort and to minimize the possibility of the inadvertent extensior thrust positioning that can otherwise occur. However, it will be seen that the seat back may be angularly inclined to a position that is at a greater than 90° angle with respect to the seat bottom. Consequently, the seat structure may be readily positioned in an optimum preferred configuration for any specific case. The structure may be positioned with the seat bottom upwardly inclined from its pivot point through the adjustable, slotted bracket 32 and the seat back may be independently positioned with respect to the seat bottom. Additional to the angular support of the seat bottom and seat back in a desired position, the providing of selectively inflatable air cells 27 and 45 in the respective side walls enables the chair to be further adjusted to better accommodate a particular occupant. Inflation of the air cells to a desired degree not only changes the spacing between the side walls for size adjustment but the degree of inflation further provides either a more rigid or more pliable or cushioned side wall. Arrangement of the air cells in longitudinally extending relationship to the respective side walls results in continuous adjustable support with respect to each side wall surface and thus better enable the chair structure to be adapted to a particular occupant.

For convenience, the rear of the seat back 12 is provided with a storage pocket 50 for the terminal end portions of the tubes 28 and 46. This pocket 50 may be conveniently formed from a sheet of the upholstering material and attached at the bottom and side edges to the seat back. The tubes 28 and 46 are of a length to be readily pulled out a distance suitable for convenient inflation of the cells.

While a specific chair structure has been illustrated and shown, it will be readily understood that a structure may be modified to achieve the same objectives through utilization of the inflatable air cells. For example the structure may be designed for positioning in therapeutic water baths and consequently would not necessarily be provided with the padded and upholstered exterior sheathings.

It will be readily apparent from the foregoing detailed description thereof, that a particularly beneficial and novel therapeutic chair is provided for the spastic cerebral palsied child. The structure including the angularly adjustable seat bottom and seat back with the necessary lateral size adjustment and support air cells results in a chiar uniquely capable of assisting and maintaining a child in a predetermined configuration and preventing the undesirable contortion of the body as a result of extensor thrust positioning.

Having this described this invention, what is claimed is:

1. A therapeutic chair comprising a supporting base a seat bottom including a bottom panel and longitudinally extending, rigid side walls disposed at opposite sides thereof in upwardly projecting relationship to said bottom panel, said seat bottom mounted on said supporting base for relative pivoting movement about a horizontal axis extending transversely to said seat bottom, and a seat back mounted on said base in upstanding relationship to said seat bottom at the rear thereof, said seat back including a back panel and vertically extending, rigid side walls disposed at opposite sides of said panel in forwardly projecting relationship thereto, each of said side walls of said seat bottoms and said seat back having respective inwardly facing surfaces and a selectively inflatable cell mounted on each respective side wall at the inwardly facing surface thereof, each of said inflatable cells having an inwardly facing surface portion displaceable independently toward the center of the chair in supporting relationship to an occupant of the chair.

2. A therapeutic chair according to claim 1 wherein each of said cells extends substantially the length of the respective seat bottom side walls.

3. A therapeutic chair according to claim 1 wherein said seat bottom is pivotable between a horizontal position and selected positions where said bottom panel is inclined upwardly toward the front of the chair, the chair including means interconnecting between said supporting base and said seat bottom to maintain the angular relationship therebetween.

4. A therapeutic chair according to claim 1 wherein said seat back is mounted on said supporting base for relative pivoting movement about a horizontal axis extending transversely to said seat back.

5. A therapeutic chair according to claim 4 wherein the horizontal pivot axis of said seat bottom and said seat back are coincendent.

6. A therapeutic chair according to claim 4 including means for maintaining said seat back in a selected position to which it may be pivoted.

7. A therapeutic chair according to claim 1 wherein each of said sidewalls includes a rigid plate, a pliable covering sheath attached to an inwardly facing surface of the rigid plate and relatively displaceable thereto, and a selectively inflatable cell disposed with the rigid plate and between said plate and covering sheath for maintaining the sheathing in a predetermined inwardly displaced position.

8. A therapeutic chair according to claim 1 wherein said supporting base includes an upstanding, longitudinally extending sidewall at each side thereof, said base sidewalls spaced apart a distance to receive said seat bottom and seat back therebetween and carrying pivot means interengaging said seat bottom at the rear end portion for pivotal support thereof.

9. A therapeutic chair according to claim 8 wherein said pivot means interengages said seat back at the lower end portion for pivotal support thereof.

10. A therapeutic chair according to claim 9 wherein said seat bottom and said seat back are interleaved at respective rear and lower end portions thereof with adjacent sidewalls thereof disposed in contacting engagement, said pivot means extending through the adjacently disposed sets of base, seat bottom and seat back sidewalls and operative to clamp said sidewalls in functionally secured engagement to resist relative pivoting movement.

11. A therapeutic chair according to claim 10 wherein said seat back has the lower end portion disposed between said base sidewalls and said seat bottom has the rear end portion disposed between said seat back sidewalls.

* * * * *